United States Patent [19]

Chevalier et al.

[11] 4,103,218

[45] Jul. 25, 1978

[54] PHASE-SHIFTING SYSTEM FOR ELECTRONICALLY SCANNING ANTENNAS

[75] Inventors: Michel Chevalier; Jean-Claude Lucas; Gérard Lacoste, all of Paris, France

[73] Assignee: Thomson-CSF, Paris, France

[21] Appl. No.: 729,800

[22] Filed: Oct. 5, 1976

[30] Foreign Application Priority Data

Oct. 7, 1975 [FR] France ..... 75 30694

[51] Int. Cl.[2] ..... H01Q 3/26

[52] U.S. Cl. ..... 323/1; 343/854

[58] Field of Search ..... 307/270; 323/1, 4, 16, 323/19, 34, 119; 343/701, 757, 793, 854, 904

[56] References Cited

U.S. PATENT DOCUMENTS

| | | | |
|---|---|---|---|
| 3,708,697 | 1/1973 | Georgopoulos | 343/854 X |
| 3,710,145 | 1/1973 | Williamson et al. | 343/854 X |
| 3,792,358 | 2/1974 | Lewis et al. | 343/701 X |
| 3,806,762 | 4/1974 | Punis et al. | 323/4 X |
| 3,982,171 | 9/1976 | Gersbach | 323/1 |

*Primary Examiner*—A. D. Pellinen
*Attorney, Agent, or Firm*—Karl F. Ross

[57] ABSTRACT

A set of phase shifters associated with an array of radiators of an electronically scanning antenna are each controlled by a current-limiting amplifier which has an input stage in series with an electronic switch and an output stage connected to a source of operating voltage normally blocking a pair of diodes in the associated phase shifter. A feedback loop between the two amplifier stages includes another diode serving to stabilize the current flow through the phase-shifter diodes upon closure of the electronic switch by a control device and triggering of the input stage by a signal from a reference-voltage generator.

6 Claims, 3 Drawing Figures

PHASE-SHIFTING SYSTEM FOR ELECTRONICALLY SCANNING ANTENNAS

FIELD OF THE INVENTION

The present invention relates to a phase-shifting system for an electronically scanning radar antenna, and, more particularly to means for supplying current to a set of diodes which form part of the system.

BACKGROUND OF THE INVENTION

Electronically scanning antennas have a radiating array which is formed by a matrix of radiating sources disposed on a plane surface, the sources being horns or dipoles, for example, which are fed with primary waves. The primary waves differ in phase in such a way that the wave which is radiated into space is a plane wave whose planes of equal phase lie in a selected direction. In such antennas, the scanning of the beam is effected by varying the phase difference between the radiating sources in the array under electrical control in such a way as to alter the direction of the plane of the emergent wave. The radiating elements at the surface are associated with respective wave guides for the signal and the wave guides incorporate members termed phase shifters. The phase shifters used in electronically scanning antennas may, for example, be switching ferrites or switching diodes. Phase shifters equipped with PIN-type diodes, used in the context of the present invention, are extremely reliable and are capable at operating at very high frequencies. The function of the diode-equipped phase shifters is to produce phase increments at microwave frequencies and the accuracy with which these increments are produced is related to that of the current passing through the diodes.

In the prior art, the necessary accuracy in the conduction current is obtained by using a stabilized low-voltage power supply and external components such as a network of load resistors. However, the stabilized power supply delivers a regulated voltage which is common to all the phase-shifting diodes and, this being the case, the relatively great distance between the unregulated energy source and the stabilized power supply causes disturbances which give rise to uncontrolled phase shifts.

In addition, the level of the combined control current for the group of phase-shifting diodes, of which, to give an example, there may be from 1000 to 10,000 in an electronically scanning antenna, is such as to require the use of a high-power low-voltage power supply which is both bulky and expensive.

Because of this, it is necessary to use heavy cables to distribute the regulated voltage. Since the voltages used are low and the currents may reach several hundreds of amperes, the voltage drop in the conductors between the various phase shifters gives rise to an appreciable variation in the regulated voltage supplied to the load which exceeds the 7% limit normally tolerated. In the radiation diagram, this discrepancy gives rise to secondary lobes whose mean level is excessively high.

In addition, the large temperature variations in the phase-shifting arrangement, which are due to energy dissipation, detract from the regulating performance.

OBJECT OF THE INVENTION

The object of our present invention is to provide a phase-shifting system employing PIN diodes which does not suffer from the disadvantages mentioned above and which is not subject to the aforestated restrictions.

SUMMARY OF THE INVENTION

In a system according to our invention there is provided, in a manner known per se, an amplifier individual to each phase shifter with an input stage connected to a signal-responsive energizing circuit and an output stage connected to a source of back-biasing voltage through a series resistor along with the associated phase-shifting diode or diodes which are blocked by this back-biasing voltage as long as the amplifier output stage is cut off. Pursuant to our present improvement, that amplifier is provided with a negative-feedback loop between the amplifier stages including a further diode poled to stabilize the current drawn through the phase-shifting diode or diodes upon conduction of that output stage.

In the embodiment more particularly described hereinafter, in which the input and output stages of the amplifier comprise transistors of opposite conductivity types, the feedback diode is inserted between an emitter of the input transistor and a collector of the output transistor.

BRIEF DESCRIPTION OF THE DRAWING

The above and other features of our invention will now be described in detail with reference to the accompanying drawing in which.

SPECIFIC DESCRIPTION

Figure 1:
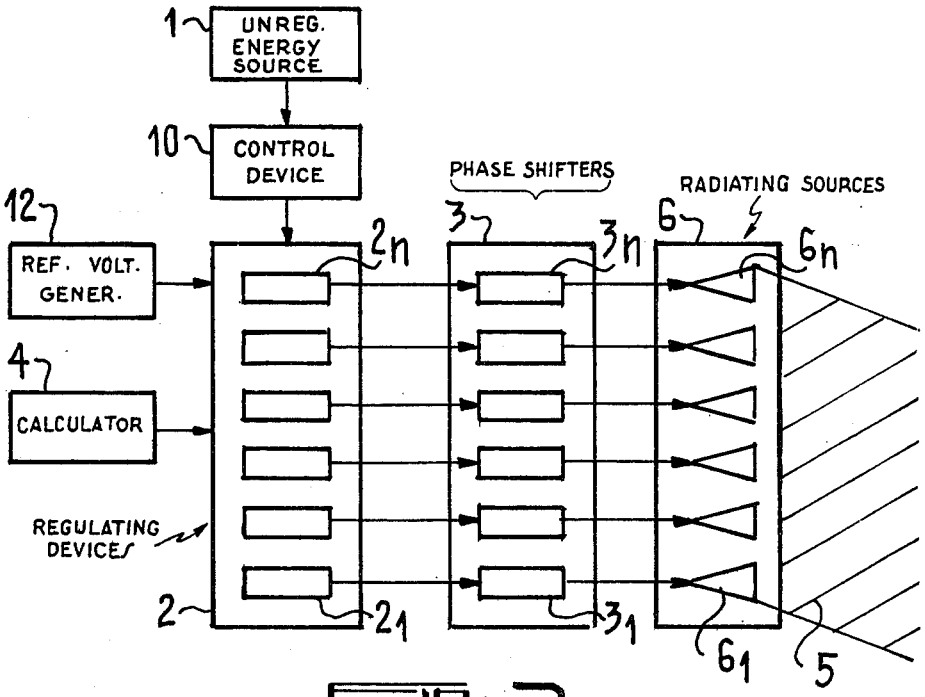
FIG. 1 is a general diagram of a phase-shifting system according to the invention.

The phase-shifting system shown in FIG. 1 includes a source 1 of unregulated energy which is connected to a device 10, for controlling the conductivity of a set of phase-shifting diodes, which is in turn connected to $n$ regulating units 2 which supply a regulated current and are associated with $n$ phase shifters 3. Each of the $n$ current-regulating units 2, individually designated $\mathbf{2}_1$–$\mathbf{2}_n$, is connected to a respective one of the $n$ phase shifters 3 which have been individually designated $\mathbf{3}_1$–$\mathbf{3}_n$ and are each formed by at least one diode in series with a resistor. The system also includes a reference-voltage generator 12, which is connected to the $n$ current-regulating units 2, and a phase calculator 4 which is connected to the same units and which generates output signals determining the amounts of phase shift to be applied to the signals emitted from a set of associated radiating sources such as dipoles 6. The phase shift applied to the signals from the dipoles 6 (individually designated $\mathbf{6}_1$–$\mathbf{6}_n$) determines the direction in which it is desired to aim the beam of the antenna.

As stated above, the accuracy of the phase shift applied to the signals is related to the regulated current passing through the phase-shifting diodes.

Figure 2:
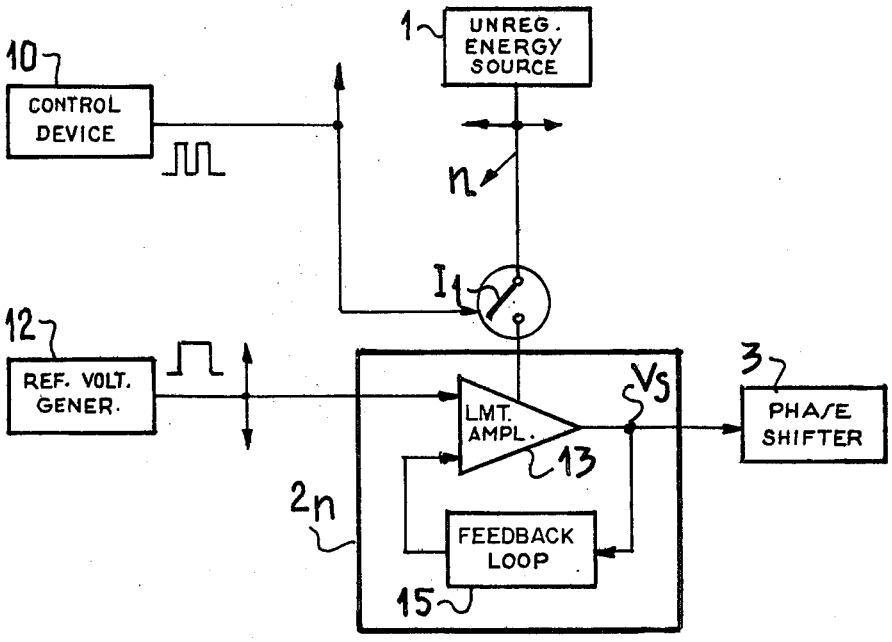
FIG. 2 is a block diagram of the supply circuitry for each phase shifter in the system of FIG. 1.

As shown in FIG. 2, the control device 10 which is connected to voltage source 1 and which is common to all the phase shifters is connected by a switch $I_1$ to a current-limiting control amplifier 13 within each phase shifter, here specifically the device $\mathbf{2}_n$. One input of the control amplifier is connected to a reference voltage generator 12 which is shared by all the phase-shifters. A negative-feedback loop 15, which may be formed simply by a diode as more fully described hereinafter with reference to FIG. 3, is connected between the output and an inverting input of amplifier 13 which delivers a regulated current to each diode in each phase shifter 3.

It is clear that the diodes cause a certain phase shift when they conduct. In cases where the phase shifter consists of two parallel branches each including a diode and a resistor in series, the resulting phase shift is $\pi/2$ when the two diodes are conducting. It will be noted that in cases where the phase shifter consists of only one diode with a resistor in series, the resulting phase shift is $\pi$. To cause conduction of the diodes of the phase shifter here described, switch $I_1$ is closed under the action of a control signal graphically represented at the output of device 10. In addition, the reference-voltage generator 12 supplies a voltage which in the example described is of the order of $-1$ volt and which is applied to the noninverting input of amplifier 13, as likewise graphically represented in FIG. 2. The requisite synchronization of devices 10 and 12 is maintained by a connection schematically illustrated as a dotted line in FIG. 3.

Figure 3:
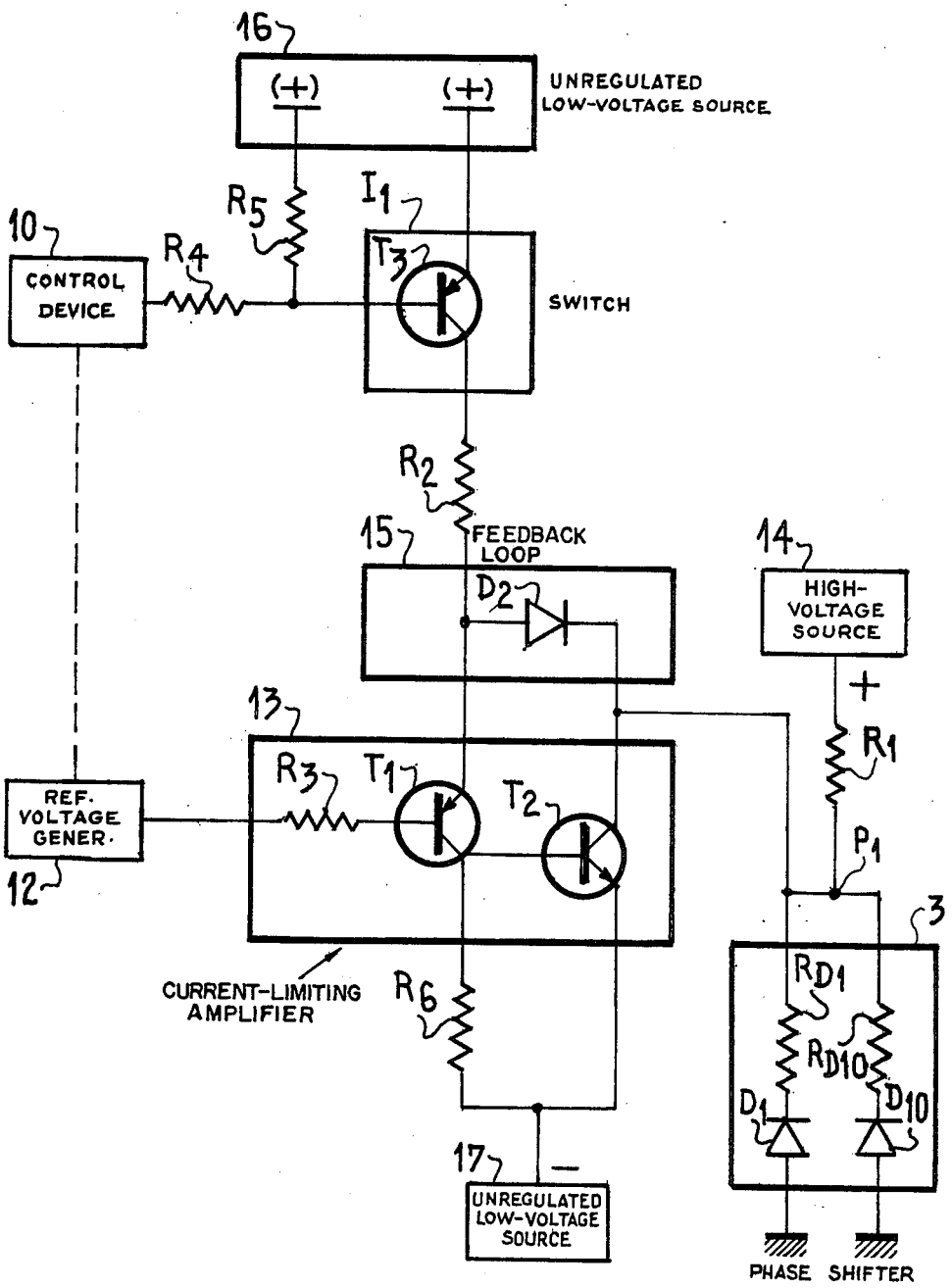
FIG. 3 is a more detailed diagram of one embodiment of the circuitry shown in FIG. 2.

As further shown in FIG. 3, amplifier 13 is formed by two cascaded complementary semiconductor components, i.e. a transistor $T_1$ of PNP type and a transistor $T_2$ of NPN type, and a diode $D_2$ connected between the emitter of stage $T_1$ and the collector of stage $T_2$. The collector of the latter transistor, which provides the output voltage $V_s$ (FIG. 2) of the regulating unit, is connected to the associated phase shifter 3 which consists of two parallel branches with diodes $D_1$ and $D_{10}$ of PIN type connected in series with respective load resistors $R_{D1}$ and $R_{D10}$. A high-voltage source 14 applies a positive blocking potential via a large series resistor $R_1$, forming a junction $P_1$ with resistors $R_{D1}$ and $R_{D10}$, to the cathodes of the two diodes. The base of transistor $T_1$ is fed via a resistor $R_3$ by the reference-voltage generator 12. The emitter of transistor $T_1$ is connected to a resistor $R_2$ tied to the collector of a transistor $T_3$ which forms part of the electronic switch $I_1$ and whose base is connected to device 10 via a resistor R4.

In FIG. 3 is the source 1 of FIG. 2 is represented by two unregulated low-voltage supply sources 16 and 17 connected to the current-limiting amplifier 13. Source 17, which is connected directly to the emitter of transistor $T_2$ and to the collector of transistor $T_1$ via a resistor $R_6$, is of negative polarity so as to cause conduction of diodes $D_1$ and $D_{10}$, whose respective anodes are grounded. The other source 16 is connected directly to the emitter of transistor $T_3$ and to the base thereof via a resistor $R_5$.

The phase-shifting diodes $D_1$ and $D_{10}$ conduct when their common input terminal $P_1$ is biased to a negative voltage substantially equal to, or higher in absolute value than ,the voltage drop in each PIN-type diode. By way of example, when the current passing through these diodes is of the order of 75 mA with a tolerance of 7%, the voltage drop in each diode plus resistor is of the order of one volt.

It should be noted that each resistor $R_{D1}$ and $R_{D10}$ limits the energy dissipation in its respective diode.

The application of a negative binary pulse of logic level "1" by control device 10 to the base of transistor $T_3$ closes the otherwise open electronic switch $I_1$ to energize the emitter of input transistor $T_1$ of amplifier 13 with voltage from source 16. If a negative signal pulse from reference-voltage generator 12 is simultaneously present on the base of this input transistor, the latter conducts and biases the base of output transistor $T_2$ positive so that this transistor also becomes conductive. Transistor $T_2$ draws current from high-voltage source 14 through the high-ohmic series resistor $R_1$ until the potential of terminal $P_1$ is sufficiently negative with reference to ground to let current flow through diodes $D_1$ and $D_{10}$, that current being stabilized by feedback diode $D_2$ which is connected in bucking relationship with the phase-shifting diodes and conducts in response to a positive potential difference between the emitter of transistor $T_1$ and terminal $P_1$. Such conduction tends to drive this emitter more negative and to reduce the conductivity of transistor $T_2$, thereby further limiting the energy dissipation in diodes $D_1$ and $D_{10}$.

Upon the disappearance of the negative control pulse from device 10, transistor $T_3$ becomes nonconductive and cuts off the transistor $T_1$ in series therewith even if the signal pulse from generator 12 is still applied to its base. Transistor $T_2$ then also ceases to conduct and the potential of terminal $P_1$ goes again positive, thus terminating the phase shift previously introduced. The emitter of transistor $T_1$ is insulated from this positive potential by the back-biased feedback diode $D_2$.

The described stabilization of the phase-shifting current, with a tolerance of 7% as noted above, affords accurate control of the radiators 6 (FIG. 1). Only a small number of components are required in each control unit 2.

What is claimed is:

1. In a system for controlling a set of phase shifters associated with respective radiators of an electronically scanning antenna, each phase shifter including at least one phase-shifting diode connected through a series resistor to a source of back-biasing voltage normally blocking conduction therethrough, there being further provided an amplifier individual to each phase shifter with an input stage connected to a signal-responsive energizing circuit and an output stage connected to said source of back-biasing voltage through said series resistor whereby said phase-shifting diode is rendered conductive upon conduction of said output stage, the improvement wherein said amplifier is provided with a negative-feedback loop between said stages including a further diode poled to stabilize the current drawn through said phase-shifting diode upon conduction of said output stage.

2. The improvement defined in claim 1 wherein said input and output stages comprise two cascaded complementary transistors, said further diode being inserted between an emitter of the input-stage transistor and a collector of the output-stage transistor.

3. The improvement defined in claim 2 wherein said energizing circuit includes an electronic switch in series with said input-stage transistor.

4. The improvement defined in claim 3 wherein said electronic switch is inserted between said emitter and a supply of unregulated voltage lower than said back-biasing voltage.

5. The improvement defined in claim 4 wherein said collector is connected to an input terminal of the associated phase shifter, said further diode being connected in bucking relationship with said phase-shifting diode.

6. The improvement defined in claim 3 wherein said energizing circuit further includes a generator of reference-voltage pulses connected to a base of said input-stage transistor.

* * * * *